United States Patent [19]

Useldinger

[11] 4,040,627

[45] Aug. 9, 1977

[54] FRICTION TYPE EXERCISING DEVICE WITH IMPROVED FRICTION SETTING MECHANISM

[76] Inventor: Ronald E. Useldinger, 1150 Wunderlich Drive, San Jose, Calif. 95129

[21] Appl. No.: 707,895

[22] Filed: July 22, 1976

[51] Int. Cl.[2] ..... A63B 21/00

[52] U.S. Cl. ..... 272/133; 188/65.4

[58] Field of Search ..... 272/133, 131; 188/65.3, 188/65.2, 65.4, 65.5; 182/5, 72, 193, 7

[56] References Cited

U.S. PATENT DOCUMENTS

| | | | |
|---|---|---|---|
| 439,263 | 10/1890 | Reichelt et al. | 272/133 X |
| 3,197,204 | 7/1965 | Holkesvick et al. | 272/133 |
| 3,220,511 | 11/1965 | Holkesvick | 188/65.4 |
| 3,250,515 | 5/1966 | Hudnall et al. | 188/65.4 X |
| 3,411,776 | 11/1968 | Holkesvick et al. | 272/133 |
| 3,472,510 | 10/1969 | Holkesvick | 272/133 |
| 3,498,608 | 3/1970 | Krug | 272/133 |
| 3,506,262 | 4/1970 | Wade | 272/133 |
| 3,510,132 | 5/1970 | Holkesvick | 272/133 X |
| 3,532,189 | 10/1970 | Wade | 272/133 |
| 3,550,449 | 12/1970 | Henson | 272/133 |
| 3,591,174 | 7/1971 | Silberman | 272/133 |

*Primary Examiner*—Richard C. Pinkham
*Assistant Examiner*—William R. Browne
*Attorney, Agent, or Firm*—Gerald L. Moore

[57] ABSTRACT

An exercising device adapted to be fixed to a support and including an elongated shaft around which a rope is wrapped as it passes into and out of the device. The exercise device includes a hub having off-center openings through which the rope is passed. The hub normally is locked against rotation but can be unlocked for rotation relative to the shaft in a combination ball and race structure which both indicates the relative position of the hub and the shaft and releasably locks the hub against rotation about the shaft. Turning the hub changes the rope turns about the shaft to adjust the pull on the device.

7 Claims, 8 Drawing Figures

FRICTION TYPE EXERCISING DEVICE WITH IMPROVED FRICTION SETTING MECHANISM

BACKGROUND OF THE INVENTION

This invention relates to exercise devices of the type utilizing a rope wrapped around a shaft so as to cause frictional engagement between the rope and shaft to resist pull on the rope. For instance, U.S. Pat. No. 3,411,776 shows such a device wherein the rope is passed into a body member around an included shaft a predetermined number of times and back out of the device. By fixing the device to a support and pulling on the rope, frictional engagement between the shaft and the rope resists the pull with a force dependent upon the number of times the rope is wound around the shaft.

Accordingly there have been provided various structures for adjusting the number of turns of the rope around the shaft. For instance in the aforementioned patent, the hub on the shaft at the end opposite to the point of entrance of the rope into the exercise device can be turned with the shaft so as to alter the number of turns of the rope around the shaft. The present invention teaches an improved method for adjusting the turns and indicating the setting of the exercise device.

SUMMARY OF THE INVENTION

An exercising device comprising a body member having an outer wall forming a hollow cylindrical walled cavity with a hub in one end supporting a shaft extending through an opening in the hub and an aligned opening in the other end of the body member, a rope passing through the hub and around the shaft a predetermined number of times, and means mounting the hub in the body member for allowing relative rotation between the hub and the shaft comprising a ball and ball race formed between the hub and body member whereby with turning of the hub the ball will move about the interior surface of the body member and be visible from the exterior of the body member at spaced points so as to render a visual indication of the relative position of the hub and body member thereby indicating the setting of the exercise device by indicia on the exterior of the body member.

DESCRIPTION OF THE INVENTION

Figure 1:
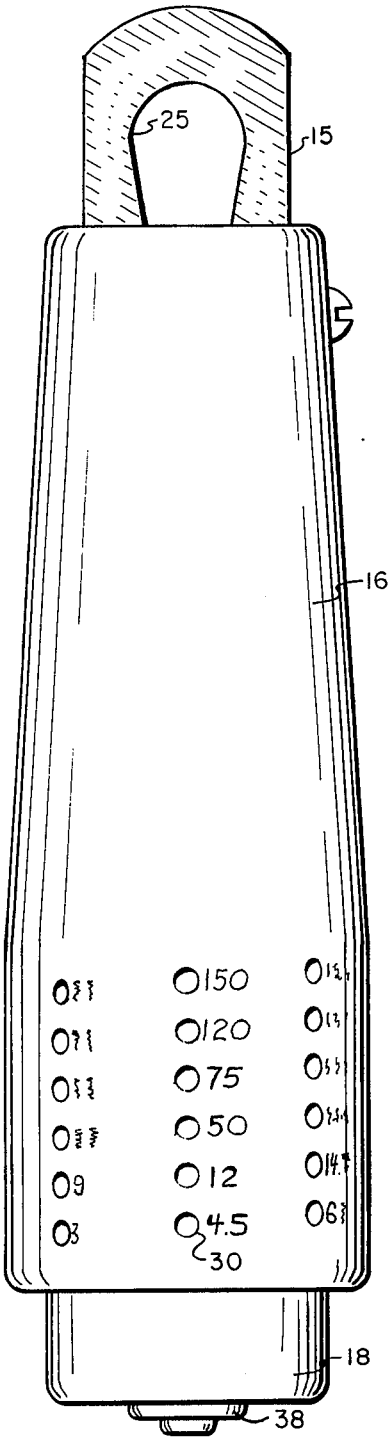
FIG. 1 shows an exercise device embodying the present invention.
Figure 2:
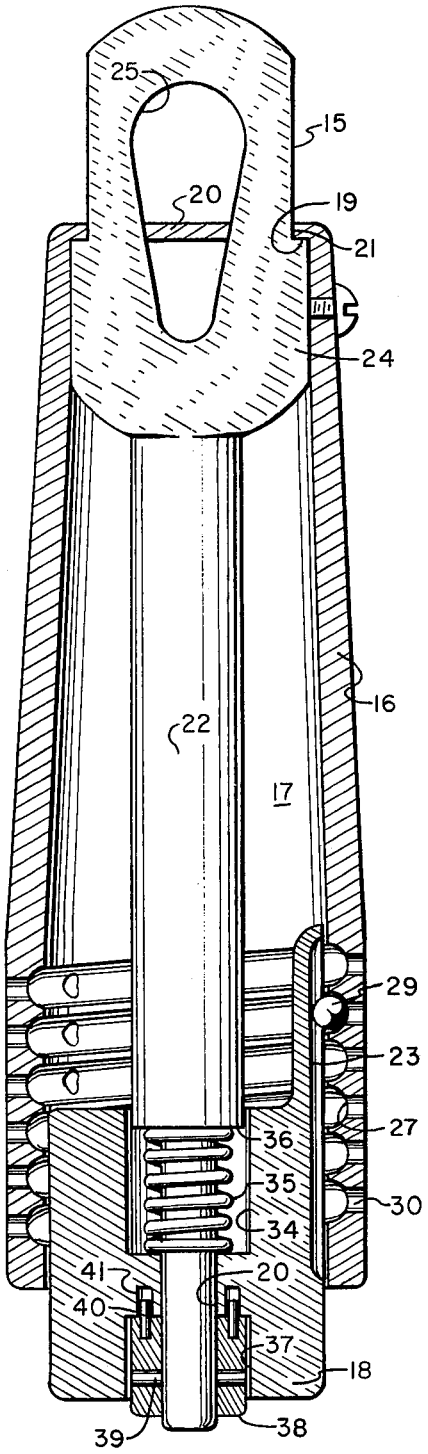
FIG. 2 is the exercise device of FIG. 1 in cross-section.

In FIGS. 1 and 2 is shown an exercise device 15 of the type incorporating the subject invention. The exercise device comprises a body member 16 forming a hollow cavity 17 with a hub 18 closing one end and an end wall 14 closing the other. Passing through aligned openings 20 and 21 in the hub 18 and wall 19 respectively is a shaft 22 having an enlarged portion 24 adjacent the end wall for maintaining concentric alignment and preventing rotation of the shaft within the body member. This shaft also includes a hole 25 adjacent and extending outside the end wall serving to permit attachment of the shaft to an exterior support (not shown) for use of the exercise device.

Figure 3:
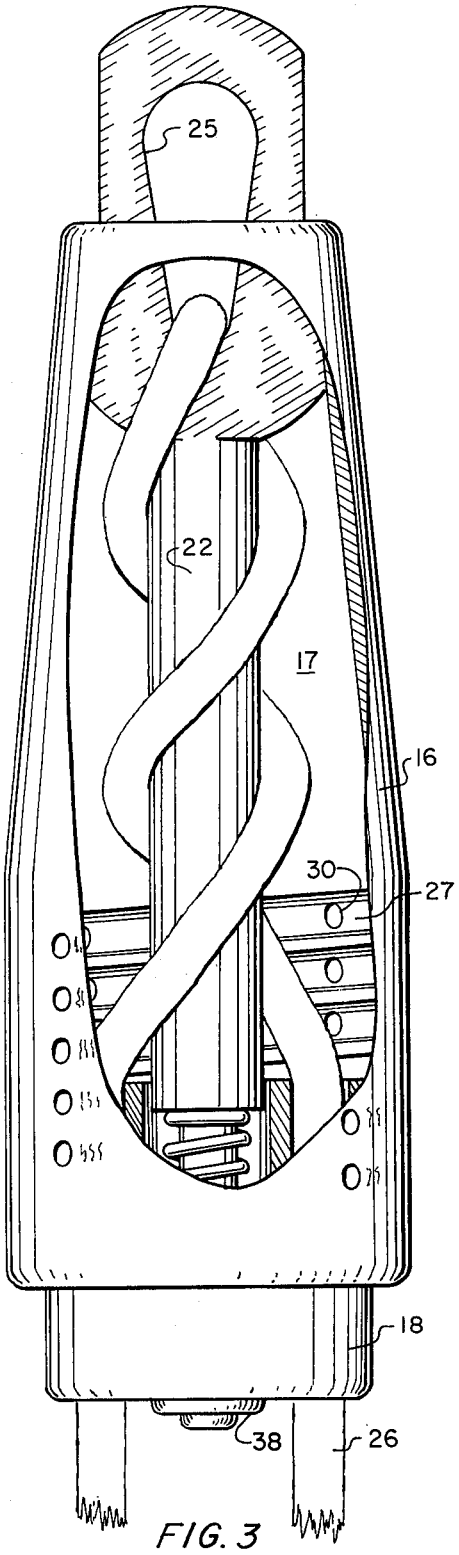
FIG. 3 is the exercise device of FIG. 1 partially cut away to the pull rope.
Figure 4:
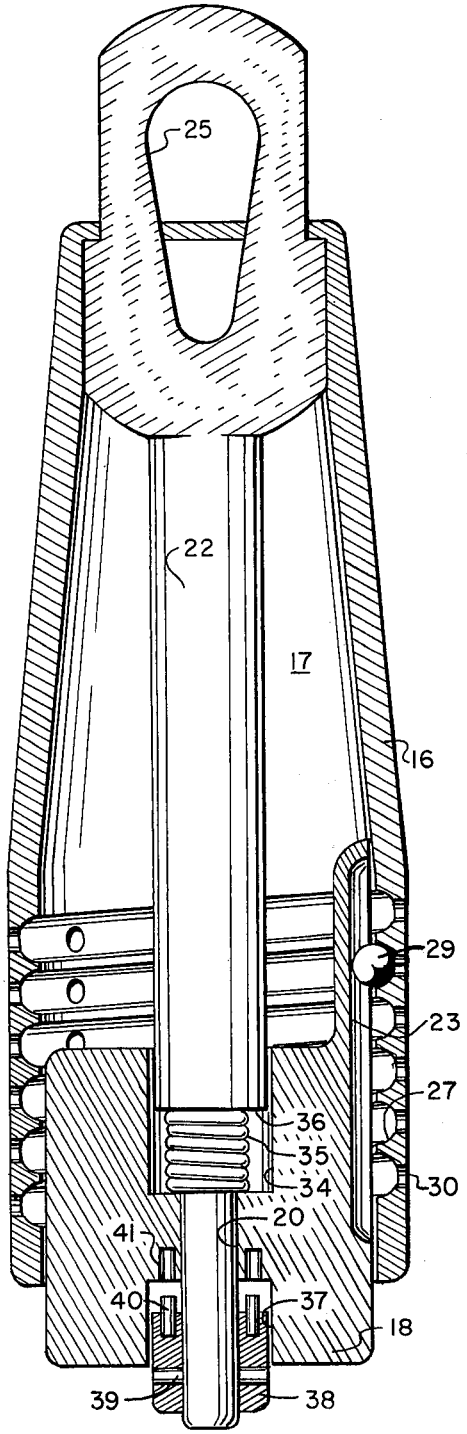
FIG. 4 shows the relative positions of the components of the exercise device when the hub is depressed to adjust the tension on the rope.
Figures 5, 6, 7, 8:
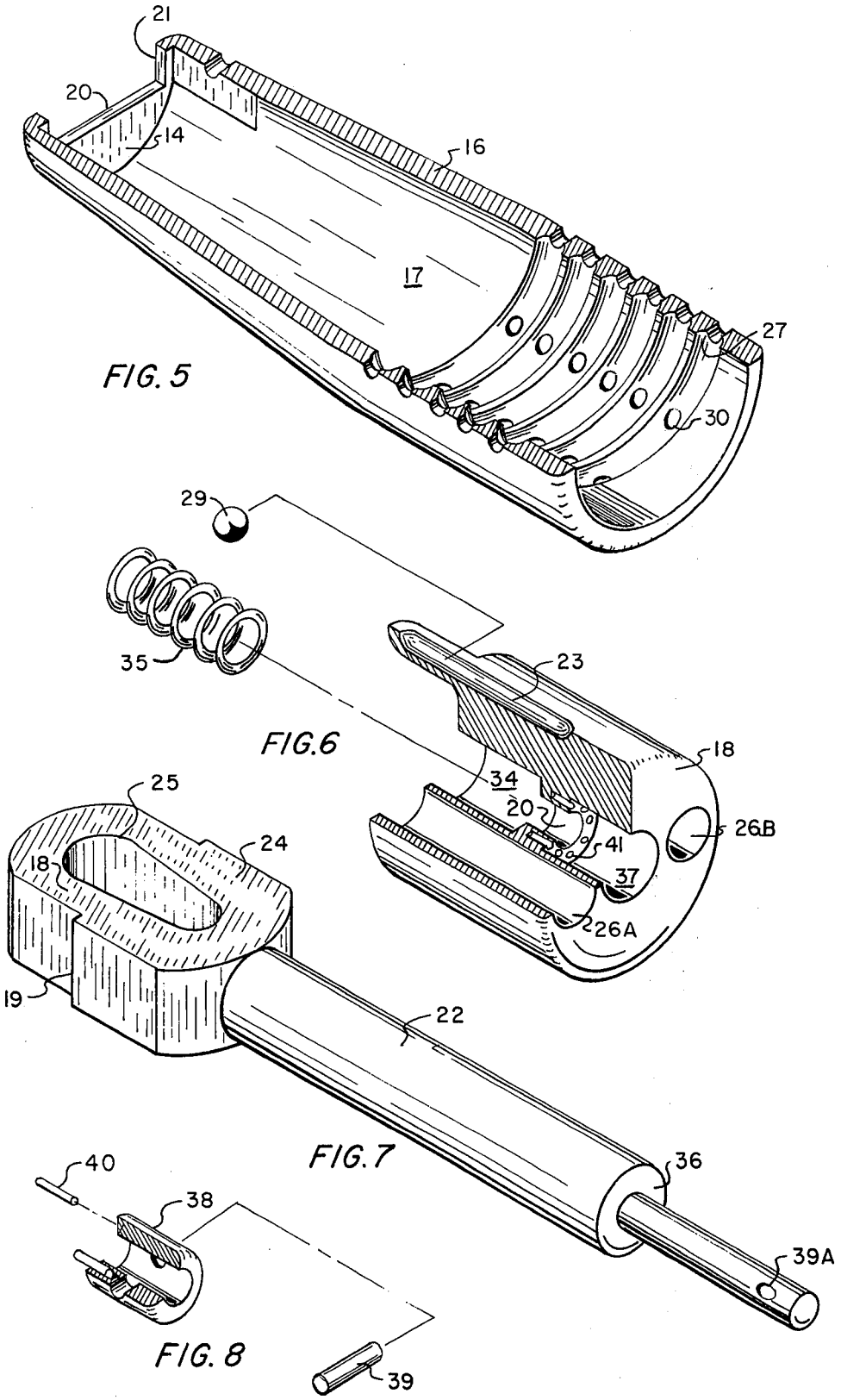
FIG. 5 is a perspective view of the body member in cross-section.
FIG. 6 is a perspective view of the hub and related components with the hub being partially in cross-section.
FIG. 7 is a perspective view of the shaft member.
FIG. 8 is a perspective view of the shaft locking assembly.

As shown primarily in FIGS. 3 and 6 a rope 26 is passed through openings 26A and 26B positioned in the hub 18 radially outward from the hole 20 through which the shaft 22 passes. The rope is wound about the shaft 22 within the cavity 17, passed through the end opening 25 of the shaft and again wound about the shaft before passage back out of the hub. Thus both ends of the rope extend through the hub 18 such that one end can be pulled to cause the rope to wind through the torturous path around the shaft and back out again. Thus it can be seen that the resistance to pull on the rope is dependent upon the number of turns of the rope around the shaft.

In accordance with the present invention, there is provided means for mounting the hub 18 for rotation relative to the shaft and the body member, which means provides for both locking the hub in any set position and for indicating the relative turns of the rope around the shaft thereby signifying the approximate tension on the rope exerted by the exercise device for that setting.

Accordingly a portion of the internal cavity in the body member 16 is formed in a cylindrical configuration having in the internal walls thereof a spiral configured half raceway 27. A complementary half raceway 23, preferably extending parallel to the center axis of the hub, is formed in the outer surface of the hub such that the hub and body member cooperate to form a full raceway 27 and 23 for receiving a ball 29. It can be seen that rotation of the hub 18 within the body member serves to cause the ball 29 to travel along the length of the spiral raceway. For each turn of the hub, one additional turn of the rope about the shaft is added or subtracted because the rope is prevented from turning about the shaft by passage through the shaft opening 25.

To indicate the relative position of the hub and shaft, there is further provided a plurality of holes 30 spaced along the length of the spiral race 27 and extending through the outer wall of the body member. These holes are slightly smaller than the diameter of the ball 29 such that the ball will tend to come to rest in the openings as it rolls past because of the slight depression in the raceway wall resulting from the opening. Of course the position of the ball in the body member could also be observed if the body member were made of transparent material.

As additional locking for the hub member 18 there is a shaft locking assembly comprising cooperating members on the shaft and the hub. As illustrated in FIGS. 2 and 6, the hub includes a cavity 34 positioned concentric with the opening 20 into which a coil spring 35 extends between the end of the cavity in the hub and a shoulder 36 on the shaft. A second cavity 37 at the outer end of the hub abuts a locking member 38 fixed to the shaft by a locking pin 39 passing through the locking member and an opening 39A in the shaft. Fixed to this locking member are a pair of pins 40 extending axially towards the hub. As shown in FIG. 6 a plurality of axial extending openings 41 are located in the hub equally spaced from the hub axis and angularly positioned to correspond to rows of openings 30 in the body member.

Thus by grasping the hub and exerting an axial force thereon to press it partially into the body member 16 by compression of the spring 35, the ends of the pins 40 are caused to clear the openings 41 in the hub member. Thereafter the hub member can be rotated to the position desired as indicated by a viewing of the position of the ball in the openings 30. Thereafter by release of this axial pressure, the hub is permitted to once again move axially under pressure of the spring 35 such that the pins 40 engage the openings 41 corresponding with that position. The detenting of the ball in the openings 30 in the body member tends to indicate alignment of the pins 40 with the proper holes 41 in the hub. Thus it can be seen that the hub and shaft are locked together against rotation such that the setting of the hub member position remains constant even though pressure is exerted on the rope which because of the rope winding around the shaft member might tend to turn the hub about the shaft axis.

Thus there is provided an improved structure for adjusting and indicating the setting of the hub member. Such adjustment mechanism serves both to index the hub and to visually indicate the hub setting so that the setting is easily read. As illustrated in FIG. 1, indicia can be positioned external to the body member on the external surface to indicate the force exerted on the rope if the hub is set to the position adjacent that indicia as detected by a visual siting of the ball 29 in the opening. Of course the ball can be colored or otherwise marked so as to be more easily visible through the opening as by coloring it a contrasting color to that of the body member 16.

The invention claimed:

1. An exercising device comprising, in combination:

a body member having an outer wall forming a hollow cavity, said body member having a central axis and axially aligned first and second openings in opposite ends thereof communicating with said cavity;

a hub positioned in said first opening and including an axially extending central opening aligning with said second opening in the body member and including a pair of second openings extending axially and positioned radially outward from the central opening;

a shaft extending through the body member second opening and the hub central opening, said shaft including a hole therein adjacent said body member second opening;

a rope-like member extending through the pair of second openings in the hub, around the shaft and through the hole therein with both ends extending out through the hub; and means for mounting the hub in the body member and allowing relative rotation thereto, said mounting means including a ball race formed by the hub outer surface and the body member cavity wall with a ball in the race positioned to travel around the body member interior wall as the hub is rotated;

releasable locking means for interlocking the hub and the shaft such that by release of said locking means the hub can be rotated about the shaft to adjust the number of turns of the rope-like member about the shaft;

and means allowing viewing of the position of the ball in the body member thereby to indicate the relative setting of the hub and the body member for determining the approximate frictional force exerted on the rope as it is pulled through the exercise device.

2. An exercise device as defined in claim 1 wherein said body member includes a plurality of holes extending radially therethrough in communication with the ball race to permit viewing of the ball with indicia on the outside of the body member adjacent each hole indicating the setting of the hub relative to the body member as the ball is positioned at that respective hole.

3. An exercise device as defined in claim 2 wherein said ball race includes on the cavity inside wall a half race extending in a spiral path and an axially extending half race on the hub cooperating with the body member half race to form a race for supporting the ball therein.

4. An exercise device as defined in claim 3 wherein said locking means includes a locking assembly fixed to the shaft external to the hub and body member comprising a pin extending axially towards the hub with said hub including openings therein into which the pin can be seated for locking the hub against rotation about the shaft.

5. An exercise device as defined in claim 4 including a spring fixed between the shaft and the hub member for pressing the hub towards the locking assembly to maintain the pin in said hub opening.

6. An exercise device as defined in claim 5 wherein said body member holes are grouped in lines extending parallel to the body member axis.

7. An exercise device as defined in claim 6 wherein said openings in the hub are aligned radially with the holes in the body member.

* * * * *